US005964610A

United States Patent [19]

McCoy

[11] Patent Number: 5,964,610

[45] Date of Patent: Oct. 12, 1999

[54] REVERSIBLE POWER ENTRY

[75] Inventor: Phillip A. McCoy, Albion, Ind.

[73] Assignee: Dekko Engineering, Inc., Butler, Ind.

[21] Appl. No.: 09/001,732

[22] Filed: Dec. 31, 1997

[51] Int. Cl.[6] ..... H01R 27/00

[52] U.S. Cl. ..... 439/218; 439/215; 439/222

[58] Field of Search ..... 439/222, 170, 439/640, 650, 221, 218, 215

[56] References Cited

U.S. PATENT DOCUMENTS

| | | | |
|---|---|---|---|
| 4,655,522 | 4/1987 | Beck, Jr. et al. | 339/32 M |
| 5,075,615 | 12/1991 | Dantis | 320/2 |
| 5,087,207 | 2/1992 | Byrne | 439/215 |
| 5,096,433 | 3/1992 | Boundy | 439/215 |
| 5,675,194 | 10/1997 | Domigan | 307/147 |
| 5,847,345 | 12/1998 | Harrison | 200/284 |

*Primary Examiner*—Edgar Burr
*Assistant Examiner*—Dane A. Ghatt
*Attorney, Agent, or Firm*—Taylor & Associates, P.C.

[57] ABSTRACT

A power supply assembly for supplying power to a modular wall panel includes a base module having a set of first mating ports and a plurality of first electrical conductors. Each first electrical conductor is electrically connected to a respective first mating port. The power supply assembly also includes a reversible coupler having a plurality of second electrical conductors therein. Each second electrical conductor is electrically connected to a respective second mating port and to a respective third mating port of the reversible coupler. The reversible coupler is selectively attached to the base module in one of two different orientations. Each second mating port is electrically connected to a respective first mating port in a first of the two orientations. Each third mating port is electrically connected to a respective first mating port in a second of the two orientations. Each second electrical conductor is electrically connected to a same first mating port in each of the two orientations.

18 Claims, 4 Drawing Sheets

REVERSIBLE POWER ENTRY

BACKGROUND OF THE INVENTION

1. Field of the Invention

The present invention relates to a power supply assembly for supplying power to a modular wall panel.

2. Description of the Related Art

Modular wall panels used in an office environment may include electrical circuitry therein to provide power to electrical equipment in the office. These modular wall panels allow flexibility in the configuration of office walls and partitions by allowing various office equipment, such as computers and lights, to be powered through the modular wall panels.

The electrical circuitry in modular wall panels is typically provided with electrical power from an external source, such as a breaker box located within the office. It is known to provide further flexibility in the design of modular wall panels by enabling the power feed line(s) to enter the modular wall panel in a range of angles or orientations. The angle or orientation of the power lines relative to the modular wall panel is selected by the user to suit the particular desired office configuration. One way of providing such flexibility is to use a power supply assembly or power entry to interconnect the modular wall panel and the power lines sourcing current thereto. The power supply assembly has a plastic cap or cover which can be mounted to the power supply assembly in at least two different orientations. The cover has an aperture or slot through which the power lines pass. The cover and aperture or slot lead or force the power lines in different directions or entry angles depending upon the orientation in which the cover is mounted.

It is also known to provide a power supply assembly with a pivotal connector which may be rotated such that the power lines approach the modular wall panel in one of two different directions. A problem is that while the power lines can approach the power supply assembly from different angles, the connections whereat the individual power lines are mated to the power supply assembly are in fixed orientations. Thus, the individual power lines are bent, and consequently may be fatigued, whenever the power lines approach the power supply assembly in an orientation different from that of their connections to the power supply assembly.

What is needed in the art is a power supply assembly providing durable, high quality electrical connections between the power lines and the modular wall panel, while at the same time allowing the user to easily switch cable orientations.

SUMMARY OF THE INVENTION

The present invention provides a power supply assembly which allows the user to quickly and easily reverse a coupler in order to change the angle of power cable entry by approximately 180°. Mating ports on the coupler and on a base module ensure highly electrically conductive and durable electrical connection therebetween.

The invention comprises, in one form thereof, a power supply assembly for supplying power to a modular wall panel. The power supply assembly includes a base module having a set of first mating ports and a plurality of first electrical conductors. Each first electrical conductor is electrically connected to a respective first mating port. The power supply assembly also includes a reversible coupler having a plurality of second electrical conductors therein.

Each second electrical conductor is electrically connected to a respective second mating port and to a respective third mating port of the reversible coupler. The reversible coupler is selectively attached to the base module in one of two different orientations. Each second mating port is electrically connected to a respective first mating port in a first of the two orientations. Each third mating port is electrically connected to a respective first mating port in a second of the two orientations. Each second electrical conductor is electrically connected to a same first mating port in each of the two orientations.

An advantage of the present invention is that the orientation of the power lines entering the modular wall panel can be quickly and easily changed by unplugging a coupler from a base module, reversing the orientation of the coupler, and again plugging the coupler into the base module.

Another advantage is that the power lines are subject to virtually no fatigue associated with a reversal of the orientation of the wires.

Yet another advantage is that the respective mating ports of the reversible coupler and the base module ensure highly electrically conductive, durable electrical connections therebetween.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
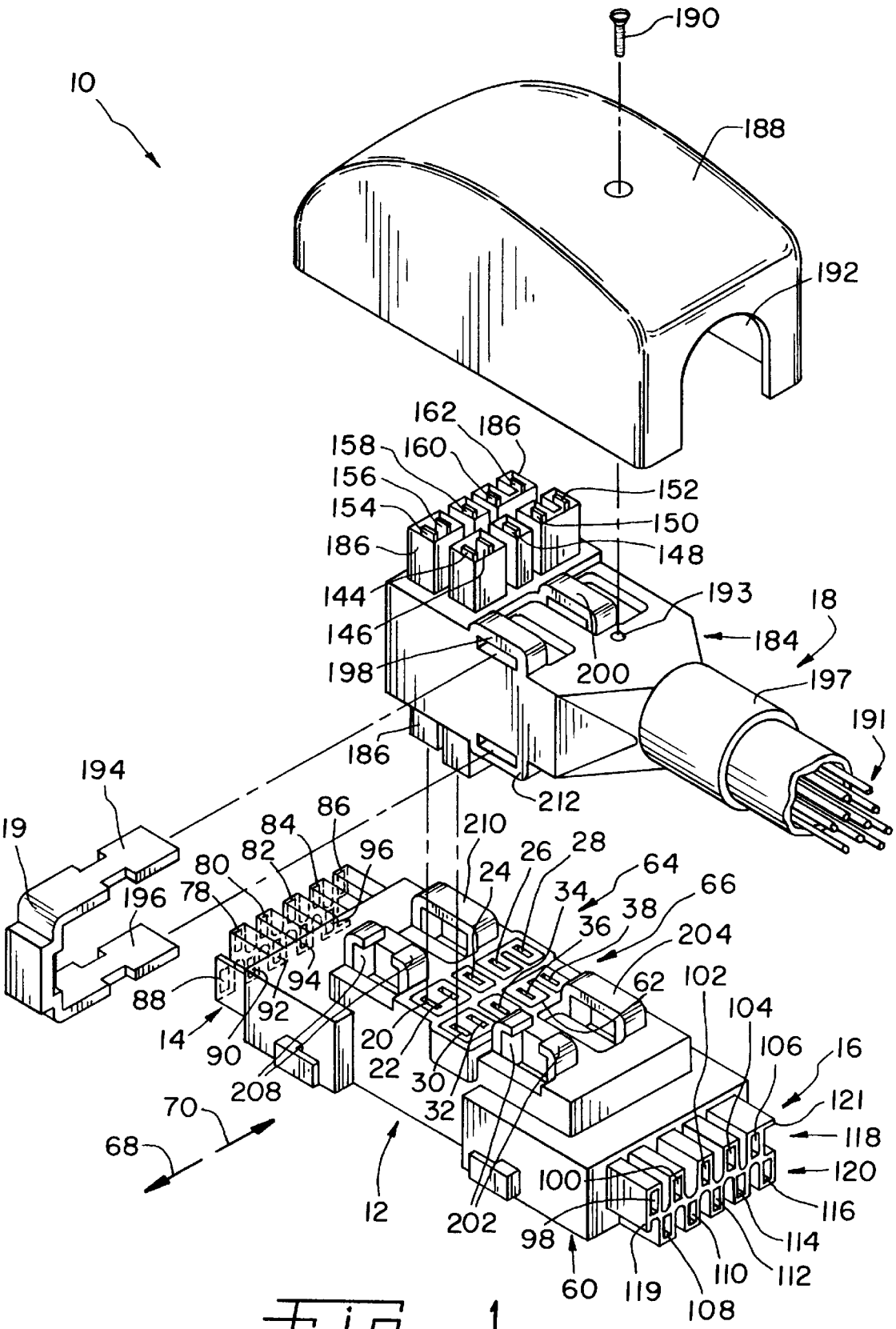
FIG. 1 is an exploded, perspective view of one embodiment of a reversible power entry of the present invention.

Referring now to the drawings, and more particularly to FIG. 1, there is shown one embodiment of a power supply assembly 10 of the present invention, also called a reversible power entry, including a base module 12, a pair of electric plug-in connectors 14 and 16, a reversible coupler 18, and a locking strap 19.

Figure 4:
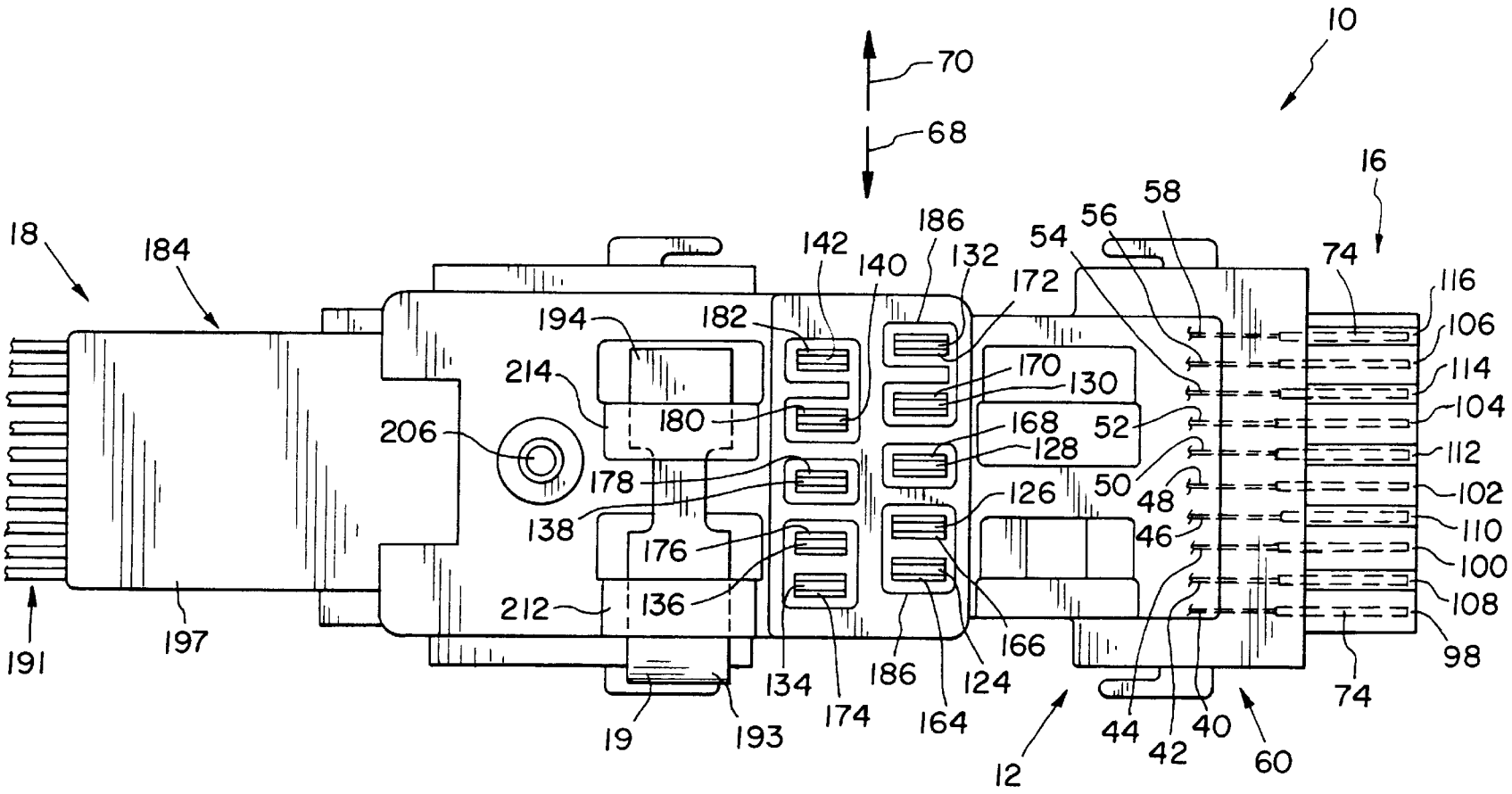
FIG. 4 is a top, fragmentary, sectional view of the reversible power entry of FIG. 1 in the orientation of FIG. 2.

Base module 12 includes a set of ten first mating ports 20–38, each of which is electrically connected to an associated one of ten first electrical conductors 40–58 (FIG. 4). For instance, first mating port 20 is electrically connected to first electrical conductor 40, first mating port 22 is electrically connected to first electrical conductor 42, and so on. First mating ports 20–38 are arranged in two parallel rows, with ports 20–28 forming one row 64 and ports 30–38 forming the adjacent, parallel row 66. Each of rows 64 and 66 is aligned along a common longitudinal direction, indicated by double arrows 68 and 70. Rows 64 and 66 are offset in the longitudinal direction relative to each other, with each port having a position in the longitudinal direction approximately midway between adjacent ports in the adjacent row. This offset of rows 64 and 66 in the longitudinal direction allows each first electrical conductor 40–58 connected to an associated first mating port 20–38 to be arranged side-by-side in a compact fashion.

Figure 2:
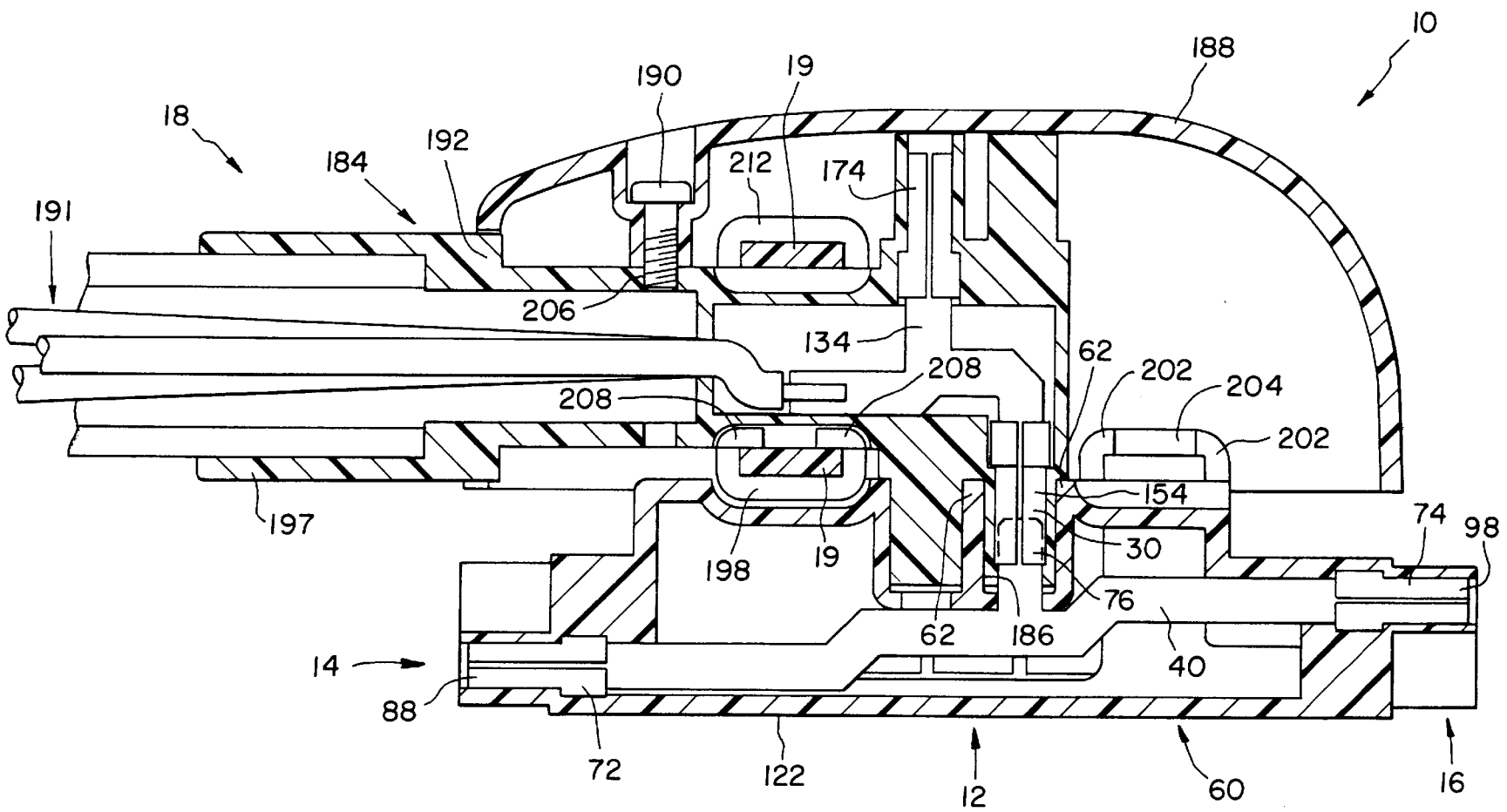
FIG. 2 is a side, sectional view of the reversible power entry of FIG. 1, showing selected electrical conductors.

Each first electrical conductor 40–58 is substantially flat and is oriented in a plane including its associated first mating port, the plane being oriented substantially perpendicular to the longitudinal direction. Each first electrical conductor 40–58 includes three terminals 72, 74 and 76 (FIG. 2). Each terminal 72 is electrically connected to electric plug-in connector 14, and, likewise, each terminal 74 is electrically connected to electric plug-in connector 16. Each terminal 76 is electrically connected to a corresponding first mating port 20–38. The first two first mating ports of each of rows 64 and 66, namely first mating ports 20, 22 and 30, 32 are disposed closer together than are other first mating ports in the same rows. First mating ports 20–38 and first electrical conductors 40–58 are all housed within a plastic body 60. Body 60 includes barriers 62 surrounding selected first mating ports. The reason for the closer spacing of first mating ports 20, 22 and 30, 32, as well as the function of barriers 62, will later be described in detail hereinafter.

Each of electric plug-in connectors 14 and 16 is carried by and disposed at opposite ends of base module 12. Plug-in connector 14 includes ten terminal receiving openings 78–96. Likewise, plug-in connector 16 includes ten terminal receiving openings 98–116. Terminal receiving openings 98–116 are arranged in two adjacent parallel rows, namely upper row 118 and lower row 120. Similarly to first mating ports 20–38, openings 98–106 of upper row 118 are offset in the longitudinal direction relative to openings 108–116 of lower row 120. Also similar to first mating ports 20–38, the first two openings 98 and 100 of upper row 118 and the first two openings 108 and 110 of lower row 120 are disposed closer to one another than are the other openings in the same rows. The obvious difference is that rows 118 and 120 are disposed one above the other, while rows 64 and 66 are disposed side-by-side. Openings 98 and 106 include projections 119 and 121, respectively. An associated connector (not shown) of a modular wall panel includes notches for receiving projections 119 and 121, ensuring that the associated panel connector can mate with plug-in connector 16 in only one desired orientation. The terminals of the associated modular wall panel connector are also variedly spaced such that they mate with the variedly spaced openings 98–116 in only the desired orientation.

Each terminal receiving opening 78–96 receives and is electrically connected to an associated terminal 72 of an associated first electrical conductor. Likewise, each terminal receiving opening 98–116 receives and is electrically connected to a terminal 74 of an associated first electrical conductor. Terminal receiving openings 98–116 being arranged in two parallel, longitudinally offset rows allows terminals 74 to be arranged side-by-side in a compact, staggered fashion. The structure of terminal receiving openings 78–96 of plug-in connector 14 is substantially identical to that of terminal receiving openings 98–116 of connector 16, and is not described in detail herein. Base module 12 has a substantially flat or planar bottom 122 for being closely received within a track of a modular wall panel.

Reversible coupler 18 carries ten second electrical conductors 124–142 (FIG. 4). Each second electrical conductor 124–142 is electrically connected to both an associated second mating port 144–162, and an associated third mating port 164–182. For instance, second electrical conductor 124 is electrically connected to both second mating port 144 and to third mating port 164. Second mating ports 144–162 are also arranged in two parallel rows with each second mating port being offset in the longitudinal direction relative to adjacent second mating ports of the adjacent row. Second mating ports 144–162 are arranged substantially symmetrically to first mating ports 20–38 so that each second mating port 144–162 can be matingly received within a corresponding first mating port 20–38. Second mating ports 144–162 are shown as being of the male variety, while first mating ports 20–38 are shown as being of the female variety. However, it is to be understood that second mating ports 144–162 can be of the female variety with first mating ports 20–38 being of the male variety. Alternatively, each of second mating ports 144–162 and first mating ports 20–38 can be hermaphroditic. Each first mating port 20–38 is shown as being formed unitarily or monolithically with its respective first electrical conductor 40–58. Similarly, each second mating port 144–162 and each third mating port 164–182 is shown as being formed unitarily or monolithically with its respective second electrical conductor 124–142. However, it is to be understood that any or all of the ports can be separate pieces that are crimped, soldered, or otherwise attached to their respective electrical conductor.

Reversible coupler 18 includes a plastic body 184 having barriers 186 surrounding selected ones of second mating ports 144–162. Barriers 62 of module body 60 matingly interlock with barriers 186 of coupler 184 to ensure that second mating ports 144–162 can mate with first mating ports 20–38 in only the orientation shown. For example, if second mating ports 144–162 were to be withdrawn from first mating ports 20–38, and coupler 18 rotated 180° in a plane parallel to bottom 122, barriers 62 and barriers 186 would not interlock. Rather, barriers 62 and 186 would interfere or block each other, preventing coupler 18 from mating with base module 12 in this undesired orientation. Thus, barriers 62 and 186 function as a keying arrangement to ensure that each of second electrical conductors 124–142 can be electrically connected only to a certain, associated first mating port 20–38. In addition, the first two mating ports 20, 22 of row 64 and the first two mating ports 30, 32 of row 66 are disposed more closely to each other than are the other mating ports in the rows. The first two mating ports in each of the two rows of second mating ports 144–162 are correspondingly closely spaced. This varied spacing of mating ports, would, in itself, ensure that first mating ports 20–38 receive second mating ports 144–162 in only one desired orientation. Moreover, it is to be understood that virtually any combination of mating projection and cavity on module body 60 and coupler body 184 could also be used to ensure mating between first mating ports 20–38 and second mating ports 144–162 in only one orientation. The structure of third mating ports 164–182 is substantially identical of that of second mating ports 144–162, and is not described in detail herein.

Figure 3:
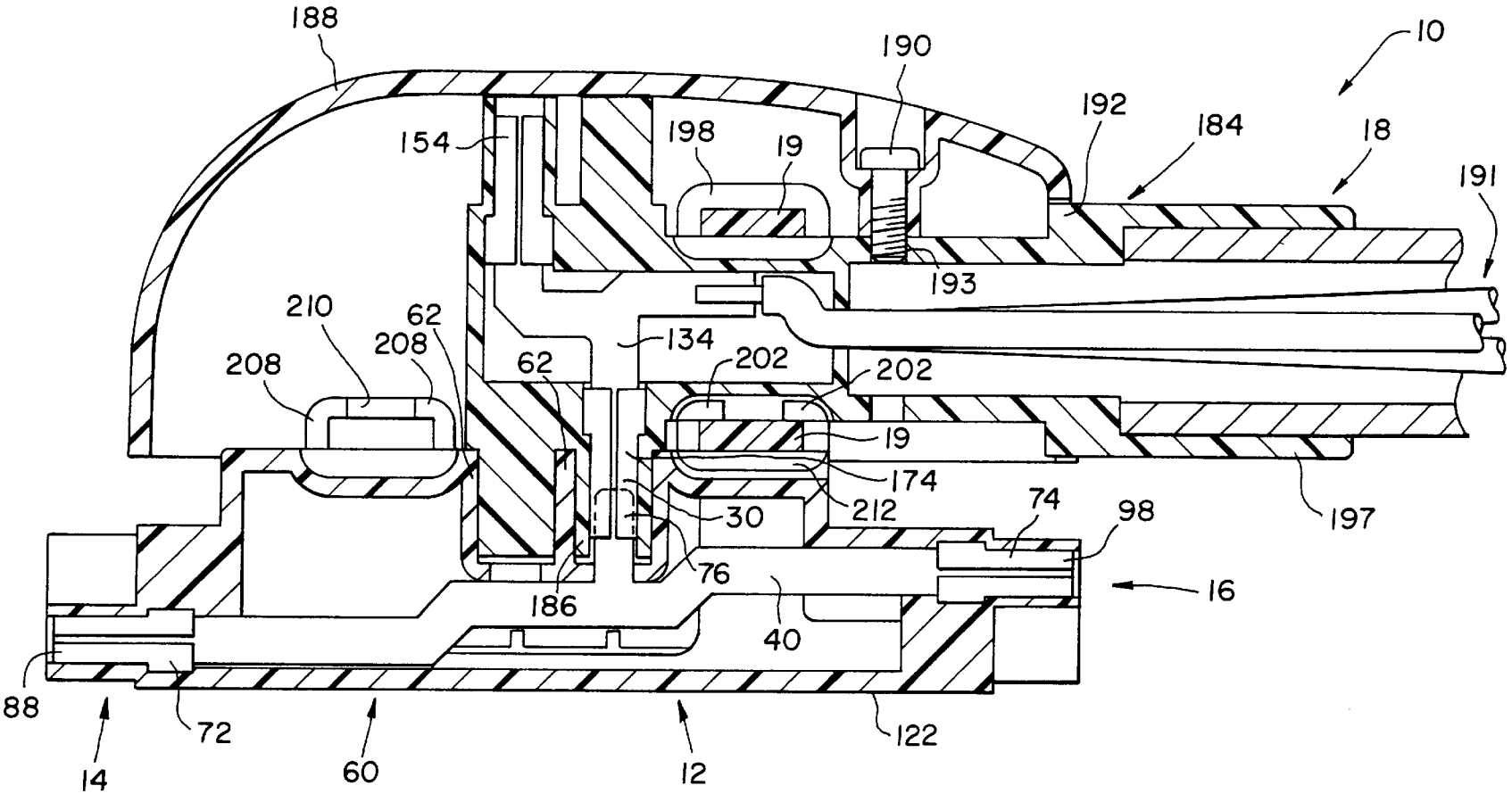
FIG. 3 is a side, sectional view of the reversible power entry of FIG. 1 in an orientation opposite from FIG. 2, showing selected electrical conductors.

A plastic cover 188 is secured to coupler body 184 by a screw 190 inserted into screw hole 193 in the orientation of FIG. 3, and into screw hole 206 in the orientation of FIG. 2. Ten wires 191 are guided by tube 197 of coupler body 184 through aperture 192 of cover 188. Each wire 191 is connected to an associated second electrical conductor 124–142.

Locking strap 19 locks or clamps together base module 12 and coupler 18 so that they cannot become inadvertently disengaged. Locking strap 19 is substantially U-shaped and includes two identical, opposing ends 194 and 196. Body 184 includes an edge loop 198 and a central loop 200, both of loops 198 and 200 being adjacent second mating ports 144–162. Loops 198 and 200 are shown in FIG. 1 as receiving end 194 of locking strap 19. Body 184 also includes an edge loop 212 and a central loop 214, both of loops 212 and 214 being adjacent third mating ports 164–182. Loops 212 and 214 are shown as receiving end 196 of locking strap 19. Likewise, body 60 of base module 12 includes a pair of brackets 202 and a loop 204 which can be disposed in alignment with loops 212 and 214. End 196 of locking strap 19 is extended through each of loop 212, brackets 202, loop 214 and loop 204, thereby locking reversible coupler 18 to base module 12. Of course other devices, such as, for example, screws, can also be used to secure coupler 18 to base module 12.

Wires 191 are shown in FIG. 3 as exiting to the right of reversible power entry 10. To better suit a particular office equipment configuration, however, it may be desired that wires 191 exit to the left of reversible power entry 10, as shown in FIG. 2. In order to switch from the configuration shown in FIG. 3 to the configuration of FIG. 2, screw 190 is removed, allowing cover 188 to be removed from coupler body 184. Locking strap 19 is then withdrawn from loops 198, 200, 212, 214 and 204 and brackets 202. It is then possible to pull coupler 18 away from base module 12, disengaging third mating ports 164–182 from first mating ports 20–38. Coupler body 184 is then rotated 180° in a plane substantially perpendicular to longitudinal direction arrows 68 and 70. In this orientation, second mating ports 144–162 may engage first mating ports 20–38 in substantially the same manner as did third mating ports 164–182. It is significant that in this orientation each second electrical conductor 124–142 is electrically connected through a corresponding second mating port 144–162 to the same first mating port 20–38 as it was formerly connected through an associated third mating port 164–182 in FIG. 3. Base module 12 includes brackets 208 and a loop 210 on the opposite side of first mating ports 20–38 from brackets 202 and loop 204. An end of locking strap 19 is extended through each of aligned loop 198, brackets 208, loop 200 and loop 210, while the opposite end of locking strap 19 is extended through loops 212 and 214. Thus, reversible coupler 18 is again locked to base module 12. Finally, to complete the assembly in the orientation of FIG. 2, plastic cover 188 is reattached to body 184 by inserting screw 190 into a screw hole 206 which is substantially identical to screw hole 193 but on the opposite side of body 184. In this second orientation also, wires 191 pass through aperture 192 of cover 188. A substantially identical procedure can be followed to switch back to the orientation of FIG. 3 from the orientation of FIG. 2, if so desired.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A power supply assembly for supplying power to a modular wall panel, said power supply assembly comprising:

a base module including a set of first mating ports and a plurality of first electrical conductors, said set of first mating ports being arranged in two substantially parallel rows of said first mating ports, each said first electrical conductor being electrically connected to a respective said first mating port; and a reversible coupler including a plurality of second electrical conductors therein, said reversible coupler having a set of second mating ports and a set of third mating ports, said set of second mating ports being arranged in two substantially parallel rows of said second mating ports, said set of third mating ports being arranged in two substantially parallel rows of said third mating ports, each said second electrical conductor being electrically connected to a respective said second mating port and to a respective said third mating port, said reversible coupler being selectively attached to said base module in one of two different orientations, each said second mating port being electrically connected to a respective said first mating port in a first of said two orientations, each said third mating port being electrically connected to a respective said first mating port in a second of said two orientations such that each said second electrical conductor is electrically connected to a same first mating port in each of said two orientations.

2. A power supply assembly for supplying power to a modular wall panel, said power supply assembly comprising:

a base module including a set of first mating ports and a plurality of first electrical conductors, each said first electrical conductor being electrically connected to a respective said first mating port;

a reversible coupler including a plurality of second electrical conductors therein, said reversible coupler having a set of second mating ports and a set of third mating ports, each said second electrical conductor being electrically connected to a respective said second mating port and to a respective said third mating port, said reversible coupler being selectively attached to said base module in one of two different orientations, each said second mating port being electrically connected to a respective said first mating port in a first of said two orientations, each said third mating port being electrically connected to a respective said first mating port in a second of said two orientations such that each said second electrical conductor is electrically connected to a same first mating port in each of said two orientations; and a pair of electrical plug-in connectors carried by and disposed at opposing ends of said base module, each said connector including a plurality of terminal receiving openings.

3. The power supply assembly of claim 2, wherein each said first electrical conductor includes three terminals, two of said terminals each being received within an associated said terminal receiving opening of a respective said connector, a third of said terminals being electrically connected with a respective said first mating port.

4. The power supply assembly of claim 1, further comprising means for locking said base module to said reversible coupler to thereby prevent said base module and said reversible coupler from being pulled apart.

5. The power supply assembly of claim 4, wherein said locking means comprises a locking strap.

6. The power supply assembly of claim 5, wherein said locking strap is U-shaped and includes opposing ends.

7. The power supply assembly of claim 6, wherein each of said base module and said reversible coupler includes at least one loop for receiving a respective said opposing end of said locking strap.

8. The power supply assembly of claim 1, wherein said reversible coupler includes a plurality of wires, each said wire being electrically connected to a respective said second electrical conductor.

9. The power supply assembly of claim 1, wherein each of said set of first mating ports, said set of second mating ports and said set of third mating ports comprises ten mating ports.

10. A power supply assembly for supplying power to a modular wall panel, said power supply assembly comprising:

a base module including a set of ten first mating ports and a plurality of first electrical conductors, each said first electrical conductor being electrically connected to a respective said first mating port;

a reversible coupler including a plurality of second electrical conductors therein, said reversible coupler having a set of ten second mating ports and a set of ten third mating ports, each said second electrical conductor being electrically connected to a respective said second mating port and to a respective said third mating port, said reversible coupler being selectively attached to said base module in one of two different orientations, each said second mating port being electrically connected to a respective said first mating port in a first of said two orientations, each said third mating port being electrically connected to a respective said first mating port in a second of said two orientations such that each said second electrical conductor is electrically connected to a same first mating port in each of said two orientations; and a pair of electrical plug-in connectors carried by and disposed at opposing ends of said base module, each said connector including ten terminal receiving openings.

11. The power supply assembly of claim 1, wherein each of said rows of first mating ports, said rows of second mating ports, and said rows of third mating ports has a longitudinal direction, said ports of one row of a selected said set of mating ports being offset in said longitudinal direction relative to said ports of another of said two substantially parallel rows of said selected set of mating ports.

12. The power supply assembly of claim 11, wherein said first electrical conductors and said second electrical conductors are oriented substantially in a plane transverse to said longitudinal direction.

13. The power supply assembly of claim 12, wherein in said second orientation, said coupler is rotated approximately 180° from said first orientation in a direction substantially parallel to said plane.

14. The power supply assembly of claim 1, further comprising means for keying said set of first mating ports with said set of second mating ports only in said first orientation, and for keying said set of first mating ports with said set of third mating ports only in said second orientation.

15. The power supply assembly of claim 14, wherein said keying means comprises matingly interlocking barriers disposed adjacent to each of said set of first mating ports, said set of second mating ports, and said set of third mating ports.

16. The power supply assembly of claim 1, wherein each said first electrical conductor and said respective first mating port are of unitary construction.

17. The power supply assembly of claim 1, wherein each said second electrical conductor is unitary with said respective second mating port and with said respective third mating port.

18. A power supply assembly for supplying power to a modular wall panel, said power supply assembly comprising:

a base module including a set of first mating ports and a plurality of first electrical conductors, each said first electrical conductor being electrically connected to a respective said first mating port;

a reversible coupler including a plurality of second electrical conductors therein, said reversible coupler having a set of second mating ports and a set of third mating ports, each said second electrical conductor being electrically connected to a respective said second mating port and to a respective said third mating port, said reversible coupler being selectively attached to said base module in one of two different orientations, each said second mating port being electrically connected to a respective said first mating port in a first of said two orientations, each said third mating port being electrically connected to a respective said first mating port in a second of said two orientations such that each said second electrical conductor is electrically connected to a same first mating port in each of said two orientations; and at least one electrical plug-in connector, each said connector being carried by and disposed at a respective one of two opposing ends of said base module, each said connector including a plurality of terminal receiving openings.

* * * * *